US009386375B2

(12) United States Patent
He

(10) Patent No.: US 9,386,375 B2
(45) Date of Patent: Jul. 5, 2016

(54) MINIATURE SPEAKER

(71) Applicant: Jing He, Shenzhen (CN)

(72) Inventor: Jing He, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 4 days.

(21) Appl. No.: 14/330,097

(22) Filed: Jul. 14, 2014

(65) Prior Publication Data

US 2015/0016639 A1 Jan. 15, 2015

(30) Foreign Application Priority Data

Jul. 15, 2013 (CN) ..... 2013 2 0420401 U

(51) Int. Cl.
*H04R 25/00* (2006.01)
*H04R 7/10* (2006.01)
*H04R 9/06* (2006.01)

(52) U.S. Cl.
CPC .. *H04R 7/10* (2013.01); *H04R 9/06* (2013.01); *H04R 2499/11* (2013.01)

(58) Field of Classification Search
CPC ..... H04R 31/006; H04R 7/14; H04R 9/025
USPC ..... 381/369, 398, 400–405, 412; 181/148, 181/157, 170, 171, 172
See application file for complete search history.

(56) References Cited

U.S. PATENT DOCUMENTS

2010/0189304 A1* 7/2010 Ueda ..... B06B 1/045 381/394
2010/0296689 A1* 11/2010 Pircaro ..... H04R 9/06 381/400
2010/0326766 A1* 12/2010 Xu ..... H04R 9/02 181/148
2012/0170792 A1* 7/2012 Li ..... H02K 33/16 381/412
2012/0170793 A1* 7/2012 Jiang ..... H04R 9/025 381/412

* cited by examiner

*Primary Examiner* — Brian Ensey
*Assistant Examiner* — Julie X Dang
(74) *Attorney, Agent, or Firm* — IPro, PLLC; Na Xu

(57) ABSTRACT

A miniature speaker is disclosed. The miniature speaker includes a frame, a magnetic circuit unit positioned by the frame and forming a magnetic gap, and a vibration unit. The vibration unit includes a vibration plate having a diaphragm including a central portion, a periphery suspending the diaphragm, a suspension surrounding the central portion with an edge connecting to the periphery, a stiffener located on the central portion, a border located on the central portion and surrounding the stiffener, and a voice coil including an inner side and an outer side opposed to the inner side. The border and the stiffener cooperatively form an interval therebetween. The stiffener controls the high frequency vibrations, and the border controls the low frequency vibrations.

14 Claims, 3 Drawing Sheets

MINIATURE SPEAKER

FIELD OF THE INVENTION

The present invention relates to electro-acoustic transducers, more particularly to a miniature speaker used in an electronic device.

DESCRIPTION OF RELATED ART

With the rapid development of wireless communication technologies, mobile phones are widely used. Users require mobile phones to not only have voice function, but also have high quality acoustic performance. A mobile phone also provides the user with entertainment contents, such as music, video, game. For converting electrical signals to audible sounds, a speaker is a necessary component used in a mobile phone for generating sounds. With the mobile phone is designed to be smaller and smaller, the speaker used therein is also required to have a low profile with small size.

Generally, a miniature speaker related to the present disclosure electrically connects to external circuits via elastic contacts. Such a miniature speaker includes a frame, a sound generator accommodated in the frame, and contacts positioned by the frame. The sound generator includes a magnetic circuit unit, a diaphragm and a voice coil driving the diaphragm to vibrate. Further, the diaphragm includes a suspension which surrounds a central portion. A stiffener is additionally provided on the central portion. The stiffener is located within the area restricted by the voice coil. An effective radiation area of such a diaphragm cannot be increased once the size of the magnetic circuit unit is determined. Thus, the acoustic performance of such a miniature speaker cannot be improved.

Accordingly, an improved miniature speaker which can overcome the disadvantages described above is desired.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment.

Figure 1:
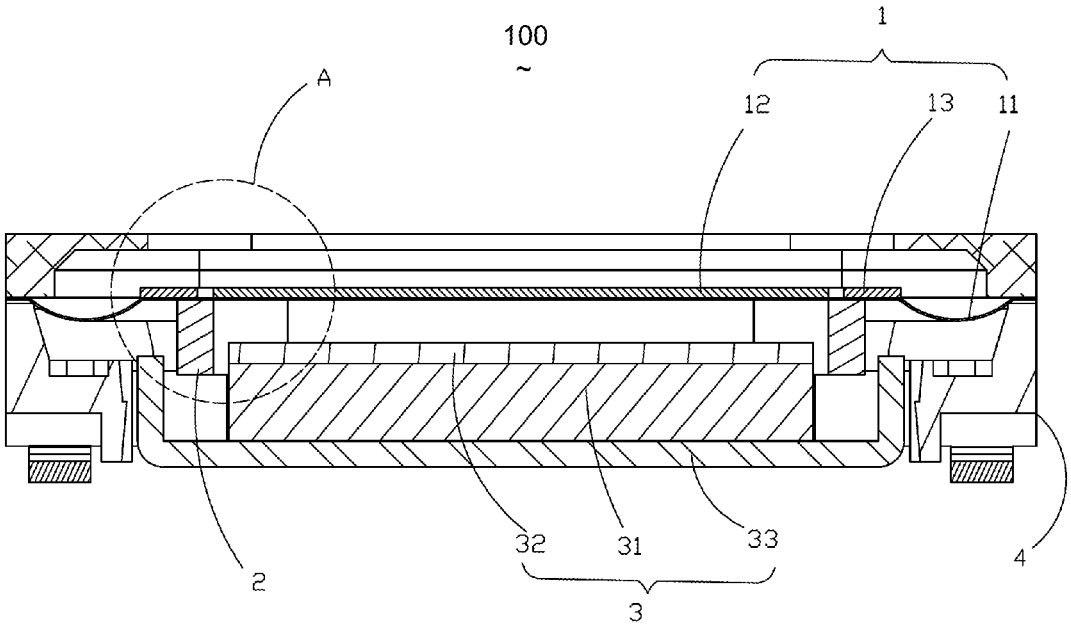
FIG. 1 is an illustrative cross-sectional view of a miniature speaker in accordance with an exemplary embodiment of the present disclosure.

Referring to FIG. 1, a miniature speaker 100 in accordance with an exemplary embodiment of the present disclosure is used in an electronic device, such as a mobile phone. The miniature speaker 100 includes a vibration unit, a magnetic circuit unit 3, a frame 4 for accommodating and positioning the vibration unit and the magnetic circuit unit 3, and a cover 5 engaging with the frame 4 for providing a space. The vibration unit includes a vibration plate 1 and a voice coil 2. The voice coil 2 attaches to a lower surface of the vibration plate 1. While the voice coil 2 is electrified, the vibration plate 1 is actuated to vibrate for producing audible sounds.

The vibration plate 1 includes a diaphragm 11, a stiffener 12 attached to an upper surface of the diaphragm 11, and a border 13 also attached to the upper surface of the diaphragm 11. The magnetic circuit unit 3 includes a lower plate 33, a magnet 31 positioned on the lower plate 33, and a pole plate 32 attached to a top of the magnet 31. The magnetic circuit unit 3 further includes a magnetic gap 34. The frame 4 includes a positioning portion 41 and a supporting portion 42 extending vertically from the positioning portion 41. A top surface of the supporting portion 42 is higher than a top surface of the positioning portion 41. The cover 5 includes an upper plate 51, an extending portion 52 extending perpendicularly from the upper plate toward the frame 4, and an acoustic hole 54 formed in the upper plate 51.

When assembled, the magnetic circuit unit 3 and the vibration unit is accommodated in the space formed by the frame 4 and the cover 5, with the magnetic circuit unit 3 engaging the positioning portion 41 of the frame 4, and the extending portion 52 of the cover 5 abutting against the supporting portion 42 of the frame 4. The extending portion 52 and the supporting portion 42 provide the vibration unit with a sufficient vibration space 53. When the voice coil 2 is electrified, the vibration plate 1 is activated by the voice coil 2 to vibrate and then produces audible sounds transmitted to outside of the miniature speaker via the acoustic hole 54. In this embodiment, the voice coil 2 is directly connected to the vibration plate 1. Alternatively, the voice coil 2 can be connected to the vibration plate 1 via other medium.

Figure 2:
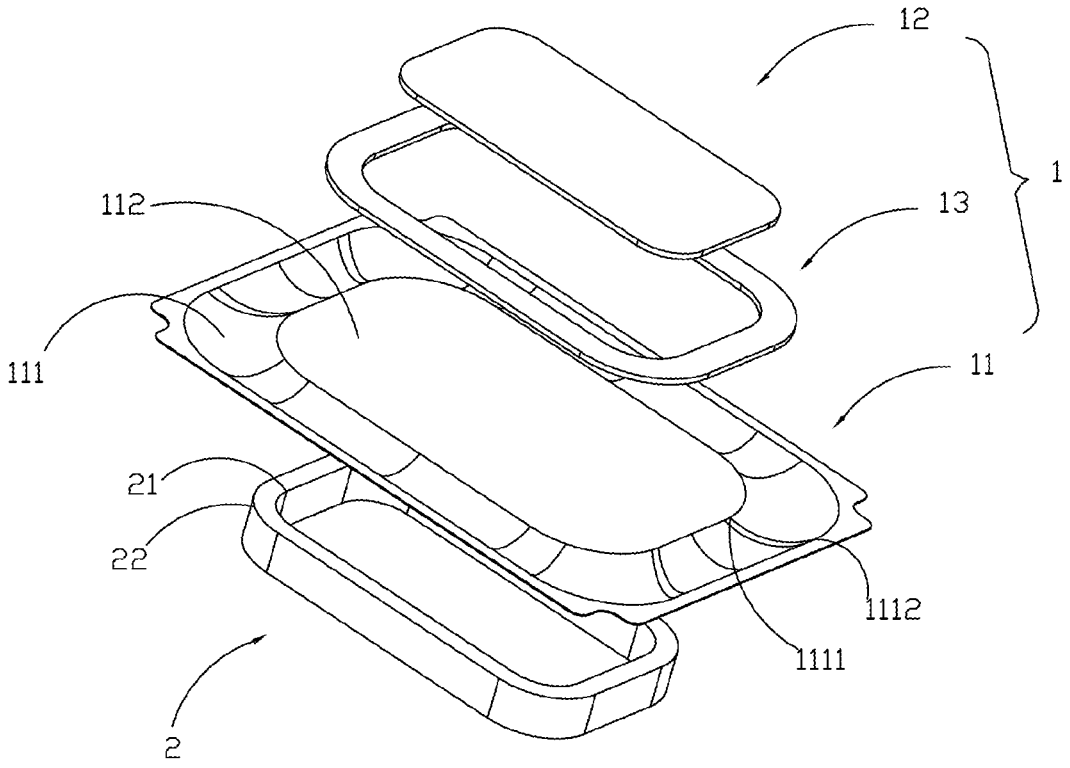
FIG. 2 is an isometric exploded view of a vibration unit used in the miniature speaker of FIG. 1.

Referring to FIG. 2, the vibration unit comprises the vibration plate 1 and the voice coil 2 described above. The diaphragm 11 includes a central portion 112 and a suspension 111 surrounding the central portion 112. In this embodiment, the central portion 112 is a planar plate, and optionally it also may be other configurations. The suspension 111 includes an inner edge 1111 connecting with the central portion 112, a periphery 1114 sandwiched between the supporting portion 42 of the frame 4 and the extending portion 52 of the cover 5 (refer to FIG. 1), an outer edge 1112 connecting with the periphery 1114, and a connecting portion 1113 located between the inner edge 1111 and the outer edge 1112. The connecting portion 1113 is a concave portion. As the periphery 1114 is sandwiched by the supporting portion 42 and the extending portion 52, the diaphragm 11 is suspended in the space formed by the frame and the cover. The stiffener 12 is disposed on the central portion 112 with an edge thereof keeping a distance from the inner edge 1111 of the suspension 111. The border 13 is a ring surrounding the stiffener 12. The voice coil 2 includes an inner side 21 and an outer side 22 opposed to the inner side 21.

Figure 3:
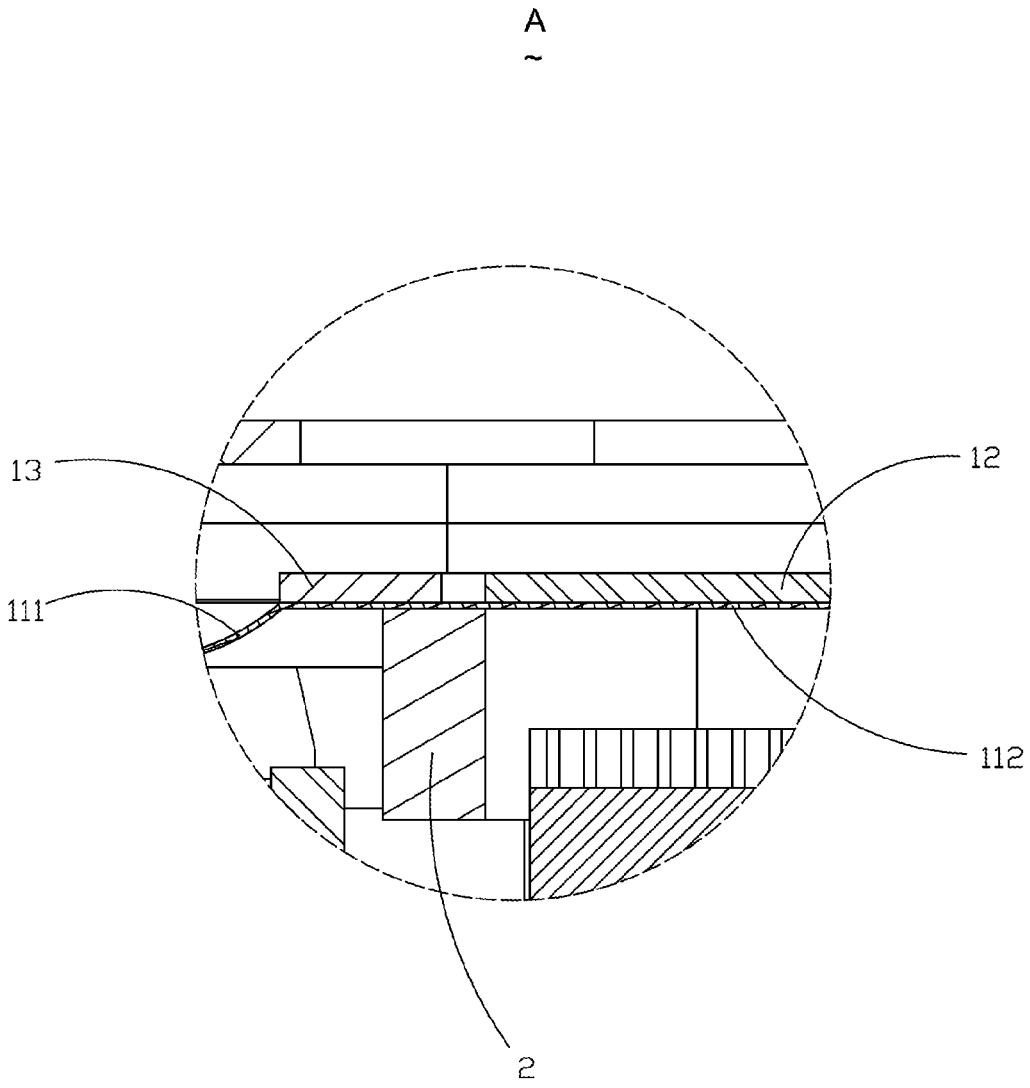
FIG. 3 is an enlarged view of Part A in FIG. 1.

Referring to FIG. 3, which is an enlarged view of Part A in FIG. 1, an interval 60 is formed between the stiffener 12 and the border 13. The voice coil 2 attaches to the lower surface of the central portion 112 with the outer side 22 keeping a distance from the inner edge 1111 of the suspension 111, and the stiffener 12 locates on the central portion 112 with the edge thereof within an area restricted by the outer side 22 of the voice coil 2. Further, the border 13 locates between the inner edge 1111 and the stiffener 12. Optionally, a projection of the border 13 along a vibration direction of the voice coil 2 is at least partially disposed between the inner edge 1111 and the outer side 22 of the voice coil 2.

The stiffener 12 and the border 13 may be made of the same material, or be made of different materials. In this embodiment, the stiffener 12 has a hardness value different from that of the border 13. Optionally, the hardness value of the border is greater than that of the stiffener 12.

By virtue of such a configuration, the effective radiation area of the diaphragm is accordingly enlarged and the percentage of the effective radiation area is improved, which improves the sensitivity of the miniature speaker, and improves the ability against high voltage. By virtue of the interval, the border and the stiffener can individually control the vibration of the diaphragm. Specifically, the stiffener controls the high frequency vibrations, and the border controls the low frequency vibrations. Thus, the acoustic performance of the miniature speaker is improved without changing the size of the magnetic circuit unit.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A miniature speaker, comprising:

a frame;

a magnetic circuit unit positioned by the frame and forming a magnetic gap;

a vibration unit including:

a vibration plate having a diaphragm including a central portion, a periphery suspending the diaphragm, a suspension surrounding the central portion with an edge connecting to the periphery, a stiffener located on the central portion, a border located on the central portion and surrounding the stiffener; and a voice coil for driving the vibration plate to vibrate along a vibration direction, and including an inner side and an outer side opposed to the inner side; wherein the border and the stiffener cooperatively form an interval therebetween.

2. The miniature speaker as claimed in claim 1, wherein the suspension includes an inner edge connecting with the central portion, an outer edge connecting with the periphery, and a connecting portion located between the inner and outer edges, the connecting portion being a concave portion.

3. The miniature speaker as claimed in claim 2, wherein the voice coil attaches to a lower surface of the central portion with the outer side thereof keeping a distance from the inner edge of the suspension.

4. The miniature speaker as claimed in claim 2, wherein a projection of the border along the vibration direction at least partially disposes between the inner edge of the suspension and the outer side of the voice coil.

5. The miniature speaker as claimed in claim 1, wherein the stiffener locates on the central portion within an area restricted by the inner side of the voice coil.

6. The miniature speaker as claimed in claim 1, wherein the frame further includes a positioning portion engaging with the magnetic circuit unit, and a supporting portion extending upwardly from the positioning portion.

7. The miniature speaker as claimed in claim 6 further comprising a cover including an upper plate and an extending portion extending from the upper plate for engaging with the supporting portion of the frame for sandwiching the periphery of the diaphragm.

8. The miniature speaker as claimed in claim 6 further comprising an acoustic hole formed in the upper plate of the cover.

9. The miniature speaker as claimed in claim 1, wherein a hardness value of the border is greater than that of the stiffener.

10. A vibration unit for a miniature speaker, comprising:

a diaphragm, including a central portion and a suspension surrounding the central portion;

a stiffener locating on the central portion with an edge thereof keeping a distance from a joint of the suspension and the central portion;

a border surrounding the stiffener;

a voice coil attached to the central portion of the diaphragm such that the central portion is sandwiched by the voice coil and the stiffener; wherein the border at least partially locates between the stiffener and the joint, and accordingly forms an interval with the stiffener.

11. The vibration unit as claimed in claim 10, wherein the diaphragm further includes a periphery connecting and surrounding the suspension.

12. The vibration unit as claimed in claim 10, wherein the suspension is a concave portion.

13. The vibration unit as claimed in claim 10, wherein the coil includes an inner side and an outer side opposed to the inner side, the outer side being a distance from a joint of the suspension and the central portion.

14. The vibration unit as claimed in claim 13, wherein the border partially locates between the outer side of the voice coil and the joint.

* * * * *